United States Patent [19]

Tezuka

[11] 4,045,304

[45] Aug. 30, 1977

[54] HIGH SPEED NICKEL PLATING METHOD USING INSOLUBLE ANODE

[75] Inventor: Junichi Tezuka, Isehara, Japan

[73] Assignee: Electroplating Engineers of Japan, Ltd., Tokyo, Japan

[21] Appl. No.: 683,250

[22] Filed: May 5, 1976

[51] Int. Cl.[2] ..... C25D 3/12; C25D 21/14; C25D 21/18

[52] U.S. Cl. ..... 204/49; 204/234

[58] Field of Search ..... 204/49, 224 R, 232-239

[56] References Cited

U.S. PATENT DOCUMENTS

| | | | |
|---|---|---|---|
| 2,449,422 | 9/1948 | Smith | 204/49 |
| 3,474,011 | 10/1969 | Guertin et al. | 204/49 |
| 3,488,264 | 1/1970 | Bailey et al. | 204/49 |
| 3,576,725 | 4/1971 | Passal | 204/49 |
| 3,963,588 | 6/1976 | Glenn | 204/16 |

FOREIGN PATENT DOCUMENTS

| | | | |
|---|---|---|---|
| 1,582,093 | 9/1969 | France | |
| 2,097,039 | 3/1972 | France | 204/232 |
| 2,252,417 | 6/1975 | France | 204/54 R |

*Primary Examiner*—F.C. Edmundson
*Attorney, Agent, or Firm*—Blanchard, Flynn, Thiel, Boutell & Tanis

[57] ABSTRACT

Excellent high speed nickel plating is achieved by using insoluble anode, detecting changes in the pH value of the plating bath during the plating operation, and supplying nickel ions to the plating bath in response to the detected changes by forcibly contacting the plating bath with metallic nickel pieces.

4 Claims, 3 Drawing Figures

Fig. 1
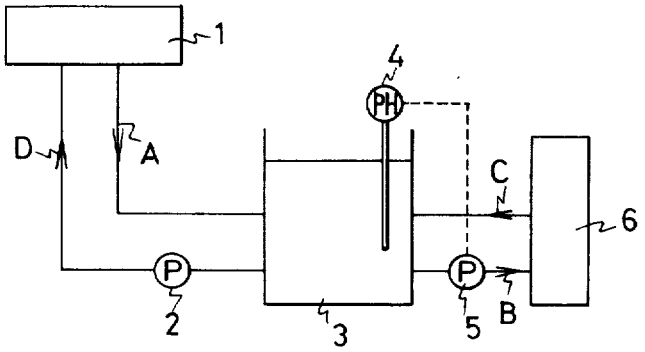
Fig. 2
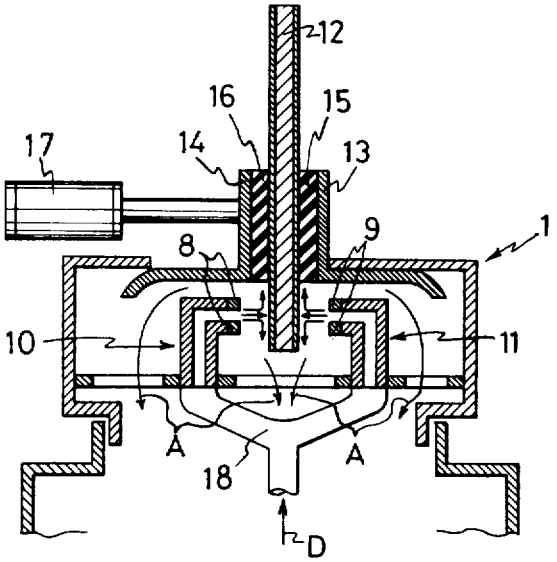
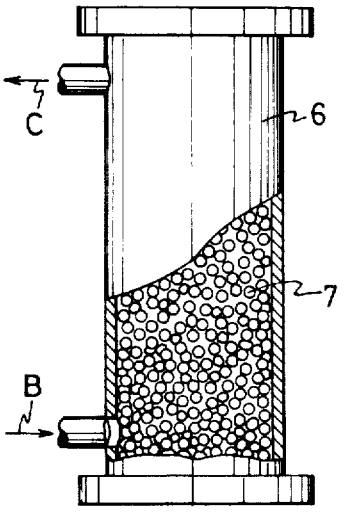
Fig. 3

HIGH SPEED NICKEL PLATING METHOD USING INSOLUBLE ANODE

The present invention concerns a high speed nickel plating method, and more in particular it concerns a high speed nickel plating method characterized in that an insoluble anode is used and the nickel ions are supplied during the plating operation not through the usual electrolysis using soluble anodes but through a forced contact of the plating bath and metallic nickel pieces, thereby controlling the pH value of the plating bath and the nickel ion concentration.

In the conventional art of nickel plating, an overwhelming number of people use either the O. P. Watts bath or sulfamate bath. These two baths usually have the following compositions and electrolytic conditions.

Table 1

| Type of bath | Composition of bath | | | | Electrolytic conditions | | |
|---|---|---|---|---|---|---|---|
| | Nickel sulfate | Nickel chloride | Nickel sulfamate | Boric acid | pH | Current density A/dm² | Temperature °C |
| Watts bath | 220 - 370 g/l | 30 - 60 g/l | | 30 - 60 g/l | 3.8 - 4.2 | 2 - 8 | 40 - 50 |
| Sulfamate bath | | 15 - 40 g/l | 330 - 650 g/l | 25 - 40 g/l | 2.5 - 4.5 | 2 - 12 | 34 - 55 |

Recently, the high speed plating method using jet nozzles and the like is coming into general use. However, this method may be applied only to the cases where insoluble anodes such as gold or rhodium are used. In other words, it is impossible to perform plating at a high speed by the conventional method of plating where a soluble anode is used and where the object being plated is immersed in the plating bath. The reasons for this are: (1) If a soluble anode were to be used in high speed plating, the anode current density becomes so great that the anode surface becomes passive and the supply of metallic ions becomes impossible: (2) In the conventional type nickel plating using the said Watts bath or sulfamate bath, the current density normally employed is below 10 A/dm², or it is impossible to perform the operation at above 10 A/dm². The current density normally used in plating for the electronics industry is less than 5 A/dm² for obtaining preferred properties of the deposit, such as minimizing the internal stress and obtaining a uniform electrodepositing property: (3) In the high speed plating method using jet nozzles and the like, there are encountered difficulties when supplying metallic ions in the conventional type baths. Supplying nickel salt is conceivable as one means of coping with the radical decrease of nickel ions. However, it becomes gradually difficult to maintain the pH value and the content of the anions of the nickel salt increases and the life of the bath remarkably shortens. Another method is to supply nickel ions by immersing metallic nickel in the bath; that is again defective in that the dissolving speed of metallic nickel into the bath is not fast enough for the deposits so that the nickel ion concentration gradually becomes lowered. Accordingly, it was difficult to perform a high speed plating with the conventional bath and even if the bath was used, it was extremely hard to maintain the bath properly.

In view of the difficulties and defects of the conventional art as above mentioned, the present invention uses an insoluble anode such as platinum, rhodium, carbon (preferably platinum) and a plating bath consisting of 350 - 400 g/l nickel sulfate and 30 - 50 g/l boric acid. The present invention provides a method of high speed nickel plating by depending on the forced contact of the metallic nickel pieces and the plating bath in supplying nickel ions to the plating bath instead of dissolving a nickel anode; and at the same time it offers a continuous and stable supply of plating bath by controlling the pH value of the plating bath and the nickel ion concentration.

In the plating bath used in the present invention, it is unavoidable that the pH value of the plating bath radically decreases caused by the decreased amount of nickel ions in the bath unless the metallic nickel pieces and the plating bath are forcibly contacted. However, if the nickel ion concentration of the bath were to be maintained constant by the above mentioned forced contact, then the pH value would remain unchanged. Thus, the change in the bath pH value would indicate the nickel ion concentration in the bath and if the pH value were to be controlled to be constant by the above mentioned forced contact, then the nickel ion concentration of the bath would also be controlled to be constant.

Accordingly, the present invention provides a method of performing a forced contact of the plating bath and the metallic nickel pieces by setting a range of pH value suitable for the plating bath on the pH meter of the detector, and if the pH value of the plating bath goes beyond such a limit due to insufficient nickel ions, the ion supplying pump connected thereto would automatically start to operate to force the plating bath to contact the metallic nickel pieces.

These and other objects and many of the attendant advantages of this invention will be readily appreciated as the same becomes better understood by reference to the following detailed description when considered in connection with the accompanying drawing.

FIG. 1 is a diagram explaining the method of the present invention;

FIG. 2 is a cross sectional view of the major part of the high speed jet plating device with the insoluble anodes attached to its jet nozzles: and FIG. 3 is a partially broken-away front view of the nickel ion supply device.

The present invention is now explained more in detail reference being made to FIG. 1 in particular wherein 1 denotes a high speed plating box, 2 denotes a plating bath circulating pump, 3 denotes a plating bath storage tank, 4 denotes a pH detector, 5 denotes a nickel ion supply pump and 6 denotes a nickel ion supply device filled with numerous metallic nickel pieces 7. The plating bath is circulated by the plating bath circulating pump 2 between the high speed plating box 1 and the plating bath storage tank 3, and also by the nickel ion supplying pump 5 between the plating bath storage tank 3 and the nickel ion supply device 6.

In the high speed plating box 1 are provided a pair of nozzles 10, 11 at the ends of which are attached insoluble platinum anodes 8, 9. Between the nozzles 10, 11 is positioned the object being plated 12. Although rhodium and carbon may be used in place of platinum as insoluble anode, platinum is most preferred as it is excellent in workability and conductivity. The object to be plated 12 is held by and between the receiving plate 13 and the pressure plate 14 and the masking portions 15, 16 of these plates hide the portions which should not be plated. This means that only the pertinent portions to be plated are positioned between the nozzles 10, 11. In the drawing, 17 denotes a pressure cylinder and 19 denotes a Y shaped pipe to supply the plating liquid to the two nozzles 10, 11.

The plating bath of the present invention has a composition most suitable for the high speed nickel plating and consists of nickel sulfate 350 - 400 g/l and boric acid 30 - 50 g/l. The electrolytic conditions are; pH 2.5 - 3.5, current density 10 - 70 A/dm$^2$ and temperature 55° - 65° C. Although nickel sulfate should be contained as much as possible, it was limited to 350 - 400 g/l because 400 g/l is close to the saturation point and if it exceeds 400 g/l nickel sulfate crystals precitate into the bath and are likely to cause difficulties in the plating treatment while if it is below 350 g/l it is impossible to obtain the nickel amount sufficient for the high speed plating treatment.

The range of boric acid was set at 30 - 50 g/l because boric acid acts as a buffer to alleviate the changes in the pH values of the bath and the amount should be as much as possible, except that 50 g/l is close to the saturation point while if it is below 30 g/l it will not present the buffering action sufficiently. The pH value was set to be 2.5 - 3.5 because if the pH value is outside this range the internal stress and hardness increase notably and pits appear in the case of high speed plating. Temperature is controlled to be between 55° C to 65° C, because if it was below 55° C it is difficult to raise the current density while the high speed plating requires a great amount of ions. If the temperature is above 65° C, the hardness, the tensile strength, the elongation and the plating finish deteriorate. Thus, the range of 55° - 65° C is set to be optimum. The current density is set to be 10 to 70 A/dm$^2$. The high speed nickel plating intended in this invention aims at 4.5 - 29 seconds for the plating time and in order to achieve this figure, the optimum range for the current density is considered to be 10 - 70 A/dm$^2$, particularly 30 - 50 A/dm$^2$.

Within the high speed plating box 1 are housed the insoluble anodes. The plating operation in this case may be any of the generally practiced methods, but the jet plating method is preferred most. During the plating operation, the plating bath flows from the high speed plating box 1 into the plating bath storage tank 3 as indicated by the Arrow A, and when the pH value lowers beyond the predetermined pH value preliminarily set on the pH detector provided in the said storage tank 3, the nickel ion supply pump 5 is automatically set into motion. Then, the plating liquid is forced (Arrow B) into the ion supply device 6 and contacts with the metallic nickel pieces 7 to cause dissolution of nickel ions. This is circulated to the nickel ion supply pump 5 and onto the plating bath storage tank 3 (Arrow C) to make up the shortage of nickel ions and to maintain the predetermined pH value as well as the nickel ion concentration in the bath, constantly. This plating liquid is supplied via the circulating pump 2 to the high speed plating box 1 (more concretely to the pair of nozzles 10, 11) (Arrow D) to be jetted toward the object being plated 12 from the end of the nozzles where insoluble anodes are attached. The use plating liquid is returned as mentioned before to the plating bath storage tank 3 (Arrow A). Thus, it is possible to give a uniform quality plating under continuous and stable conditions at a high speed to the object to be plated.

The present invention is now explained by way of a specific embodiment. 8 liters of the high speed plating bath consisting of 400 g/l of nickel sulfate and 40 g/l of boric acid, temperature 59° - 61° C, current density 40 A/dm$^2$, pH value set at b 3.5 max. and 2.5 min. was used with the high speed plating box as shown in FIG. 2 to the end of which nozzles are attached insoluble platinum electrodes. High speed nickel plating under the above conditions was performed to the area of 5 × 80 mm$^2$, and when pH value gradually lowered and reached the lower limit of 2.5, the nickel ion supply pump 5 connected to the pH detector 4 was set in motion to cause the plating bath in the plating bath storage tank 3 to flow into the nickel ion supply device 6 and to forcibly contact with the metallic nickel pieces 7 in the said device 6, thereby causing dissolution of nickel ions into the liquid and sending the said liquid back to the storage tank 3. At the same time the pH value gradually rises and when it reaches its upper limit 3.5, the ion supply pump 5 stops its action. Thus, the plating bath supplied with nickel ions is successively circulated to the plating bath circulating pump 2, to the storage tank 3, and then to the nozzles 10, 11 of the high speed plating box 1.

As above mentioned, the pH value of the plating bath during the plating operation was always controlled to be within the predetermined range of 2.5 to 3.5. The amount of metallic nickel in the plating bath was also maintained within the range of 0.7 g/l as the pH value was being controlled. The time required for performing 1 μ (40 A/dm$^2$) nickel plating to the area of 5 × 80 mm$^2$ was 7.2 seconds. The conventional Watts bath plating method would have required 72 seconds (4 A/dm$^2$). The amount of nickel consumed when 10 μ plating was given to 5 × 80 mm$^2$ at the current density of 40 A/dm$^2$ was 3.56 mmg. More than 3.4 kg of nickel tips of 2 × 2 × 0.5 mm$^3$ were used.

As confirmed in the example of this invention, the high speed nickel plating in accordance with the present invention obtains a uniform and excellent quality product. According to the present invention, it is possible to obtain an excellent adhesion between the nickel layer and a tin-lead layer when nickel is to be plated over the tin-lead layer without the aid of a copper strike. Usually when nickel is plated over the tin-lead layer, tin-lead begins to dissolve into the nickel plating bath because of the slow plating speed and impairs adhesion of nickel to tin-lead layer. Normally copper is placed between nickel and tin-lead to prevent this defect, but if the nickel plating is performed at the high speed as that of the present invention, the depositing speed is faster than the speed at which tin-lead dissolves into the nickel plating bath and the excellent adhesion is obtained, thus eliminating the need for the copper strike.

The method of nickel ion supply to the plating bath in accordance with the present invention may sufficiently be applied to the high speed plating using silver, copper or tin-lead.

I claim:

1. A process for the high speed electroplating of nickel, utilizing an electroplating solution consisting essentially of from about 350 to about 400 grams per liter of nickel sulfate and from about 30 to about 50 grams per liter of boric acid, said solution having a pH in the range of from 2.5 to 3.5, which comprises the steps of: continuously pumping a first stream of said electroplating solution from a storage tank to jet nozzle means in a plating container, said nozzle means having insoluble anode means at the tip thereof, said anode means being opposed to and being located close to the workpiece to be plated which is connected as the cathode, and directing jet means of said electroplating solution from said nozzle means against the workpiece whereby to electroplate nickel on said workpiece at a current density of from about 10 to about 70 $A/dm^2$ and at a temperature of about 55° to about 65° C; continuously returning the electroplating solution from said plating container to said storage tank; continuously monitoring the pH of the electroplating solution in said storage tank and when the pH of said electroplating solution in said storage tank has decreased to a preselected low level, pumping a second stream of the electroplating solution, separate from said first stream, from said storage tank through a vessel containing pieces of nickel metal and thence back to said storage tank whereby to increase the nickel ion content of said electroplating solution present in said storage tank and to increase the pH thereof, and continuing to pump said second stream of electroplating solution from said storage tank through said vessel until the pH of the electroplating solution in said storage tank rises to a preselected high value and then discontinuing pump of said second stream through said vessel, the pH of the electroplating solution in said storage tank being continuously maintained in the range of from 2.5 to 3.5.

2. A process as claimed in claim 1 in which the plating time is from 4.5 to 29 seconds.

3. A process as claimed in claim 2 in which the current density is from 30 to 50 $A/dm^2$.

4. A process as claimed in claim 3 in which the insoluble anode is made of platinum.

* * * * *